United States Patent [19]

Jansma

[11] Patent Number: 4,597,984

[45] Date of Patent: Jul. 1, 1986

[54] METHOD AND APPARATUS FOR COATING FLUORESCENT LAMP TUBES

[75] Inventor: Jon B. Jansma, University Heights, Ohio

[73] Assignee: General Electric Company, Schenectady, N.Y.

[21] Appl. No.: 811,891

[22] Filed: Dec. 20, 1985

Related U.S. Application Data

[63] Continuation-in-part of Ser. No. 740,460, Jun. 3, 1985, abandoned.

[51] Int. Cl.[4] ..... B05D 1/06; B05D 7/22

[52] U.S. Cl. ..... 427/28; 118/622; 427/67

[58] Field of Search ..... 118/622; 427/28, 67

[56] References Cited

U.S. PATENT DOCUMENTS

| | | | |
|---|---|---|---|
| 3,126,300 | 3/1964 | Bienefelt et al. | 118/49.1 |
| 4,081,714 | 3/1978 | Mossel et al. | 313/493 |
| 4,121,132 | 10/1978 | Repsher | 313/486 |
| 4,540,915 | 9/1985 | Shinkai et al. | 313/486 |

FOREIGN PATENT DOCUMENTS

| | | | |
|---|---|---|---|
| 454727 | 2/1949 | Canada . | |
| 478893 | 11/1951 | Canada . | |
| 661412 | 11/1951 | United Kingdom | 427/78 |
| 2040279 | 8/1980 | United Kingdom . | |

*Primary Examiner*—James R. Hoffman

*Attorney, Agent, or Firm*—N. D. Herkamp; Philip L. Schlamp; Fred Jacob

[57] ABSTRACT

Method and apparatus for electrostatically applying phosphor coatings to the interior surface of fluorescent lamp tubes includes equipment for applying an electrical charge of one polarity to the glass wall and electrical charge of the opposite polarity to the phosphor particles to cause the phosphor particles to adhere to the glass surface until the particles can be heated to bond them to the interior surface of the glass by lehring. By using electrostatic deposition the lehring may be done at a lower temperature than is required with conventional phosphor deposition using organic binders so that U-shaped fluorescent lamps do not experience distortion from the lehring temperature. The invention includes the fluorescent lamps provided which are devoid of residue of organic binder.

28 Claims, 7 Drawing Figures

Fig. 4
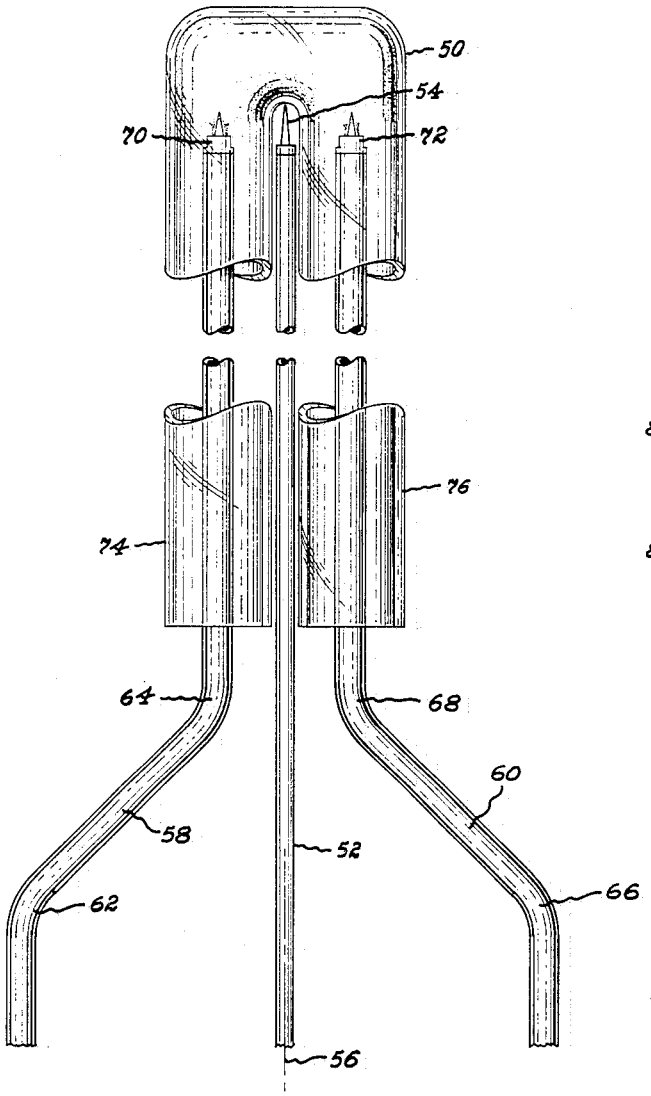
Fig. 5
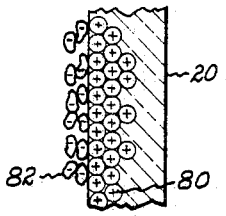
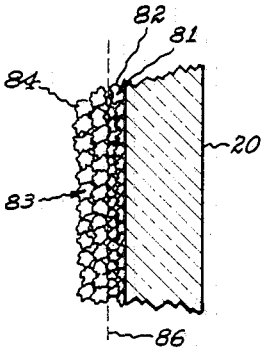
Fig. 6

METHOD AND APPARATUS FOR COATING FLUORESCENT LAMP TUBES

CROSS-REFERENCE TO RELATED APPLICATION

This is a continuation-in-part of application Ser. No. 740,460, filed June 3, 1985, now abandoned.

BACKGROUND OF THE INVENTION

1. Field of the Invention

This invention relates to fluorescent lamps and the manufacture of fluorescent lamps, and, more particularly, to a method and apparatus for applying a layer of particulate material to the inside of a fluorescent lamp bulb by electrostatic deposition and the resulting fluorescent lamp.

2. Description of the Prior Art

In the prior art techniques for manufacturing fluorescent lamps, phosphor coatings are typically applied as a suspension of particulate material in a slurry including an organic binder. The organic binder serves the function of holding the phosphor particles to the glass bulb surface during the manufacturing of the bulb. After application of the phosphor coating, the bulbs are lehred at a high temperature to vaporize the organic binder and bond the phosphor particles to the glass bulb surface and to other phosphor particles to form a uniform, well-bonded coating on the fluorescent lamp bulb. This technique requires heating of the lamp bulb to a temperature which would cause the lamp glass to soften. To prevent distortion of the fluorescent lamp bulb, straight line fluorescent lamps are conventionally rotated during the lehring process so that the gravitational effects are averaged and the lamp maintains a straight shape.

U-shaped fluorescent lamps having both sets of lamp terminals at the same end of the lamp raise a difficulty with respect to lamp coating and lehring which is not experienced in manufacturing straight fluorescent lamps. In prior art techniques of manufacturing U-shaped fluorescent lamps, the phosphor coatings are typically applied as water suspensions containing organic polymer binders which act as dispersing agents to provide smooth coating appearance. After the coatings have been applied, the binders must be removed prior to sealing of the lamp and filling with the typical fluorescent lamp atmospheres, because the organic materials of the binder are incompatible with the fluorescent lamp atmosphere and tend to cause darkening and loss of lamp efficacy in lumens per watt over the life of the lamp. The binders typically are removed by baking at elevated temperatures, i.e. lehring, for a sufficient time to vaporize the binders. When folded fluorescent lamp tubes are subjected to lehring temperatures typically used for lehring lamps coated with water-based organic binder coatings (600°–630° C.), the glass can soften resulting in distortion of the glass tube due to gravity. It is impractical to roll the folded tube during the lehring process to average gravitational effects, and, therefore, lehring must occur at lower temperatures. However, lower temperature lehring significantly lowers lamp efficacy and maintenance due to the incomplete removal of the organic binder materials. In one prior art technique for manufacturing U-shaped fluorescent lamps a tin oxide starting strip is applied to an interior surface of the fluorescent lamp extending generally from one electrode around the bend of the lamp to the opposite electrode in order to assist in starting of the lamp. If this coating is applied prior to lamp bending, difficulties are experienced in maintaining electrical continuity of the starter strip following bending of the glass tube due to the strain on the glass and therefore on the starting strip during bending. Therefore, the starting strip is typically applied after the glass tube has been bent into the desired U-shape. A difficulty experienced when using tin oxide as the starting strip results from the use of an insulating barrier coating on the tin oxide coating to overcome the poor adherence of phosphors to tin oxide and the tendency of the tin oxide to darken with exposure to the atmosphere inside the fluorescent lamp. To improve adherence of phosphor materials to the tin oxide coating, certain types of borates, e.g. calcium borate, are included within the binder material. Removal of the binders from the lamp following deposition of the phosphors requires a still higher lehring temperature when additional borate additives are used, which increases the risk of sag in the U-shaped lamps. To overcome these limitations in the manufacturing of U-shaped fluorescent lamps, a technique of applying phosphor coatings and bonding the coatings to the lamp glass without requiring high temperature lehring is required.

SUMMARY OF THE INVENTION

An object of the present invention is to provide a U-shaped fluorescent lamp having no binder residue in the phosphor coating and a method and apparatus for applying phosphor coatings to the interior surfaces of fluorescent lamp tubes without requiring the use of binder materials whose removal from the lamp requires high temperature lehring. A more specific object of the present invention is to provide an electrostatic coating technique for applying phosphor layers to the interior surfaces of a U-shaped fluorescent lamp.

Accordingly, the present invention includes an electrostatic coating apparatus having one electrode positioned outside the glass tube and at a predetermined position relative to a pair of second electrodes placed inside the glass tube during the coating process; each of the second electrodes having a nozzle attached thereto with passages therethrough for the delivery of phosphor coating material to the interior of the glass envelope and a tip for forming a corona; and connections to a high voltage d-c electrical power supply for applying voltage of a first polarity to the first electrode and voltage of a second polarity to the second electrodes; such that a field is created between the electrode tips which causes the glass tube to become electrically charged with one polarity and the particles of phosphor material to become oppositely charged, so that the phosphor particles are attracted to the interior surface of the glass tube and adhere thereto. The present invention further comprises a method of depositing phosphor coatings on U-shaped fluorescent lamps and a U-shaped fluorescent lamp having phosphor coating devoid of organic binder residue.

BRIEF DESCRIPTION OF THE DRAWINGS

Further objects and advantages of the present invention together with its organization, method of operation, and best mode contemplated may best be understood by reference to the following description taken in conjunction with the accompanying drawings in which:

FIG. 4 is an elevational view, partly in section, of an alternative embodiment of the coating apparatus of the present invention;

FIG. 5 is a greatly enlarged schematic view illustrating the fluorescent phosphor particles electrostatically bonded to the surface of a fluorescent lamp tube;

FIG. 6 is a greatly enlarged schematic view of a glass tube wall illustrating the completed bonding of phosphor particles to a lamp glass surface according to the present invention.

DESCRIPTION OF THE PREFERRED EMBODIMENTS

Figure 1:
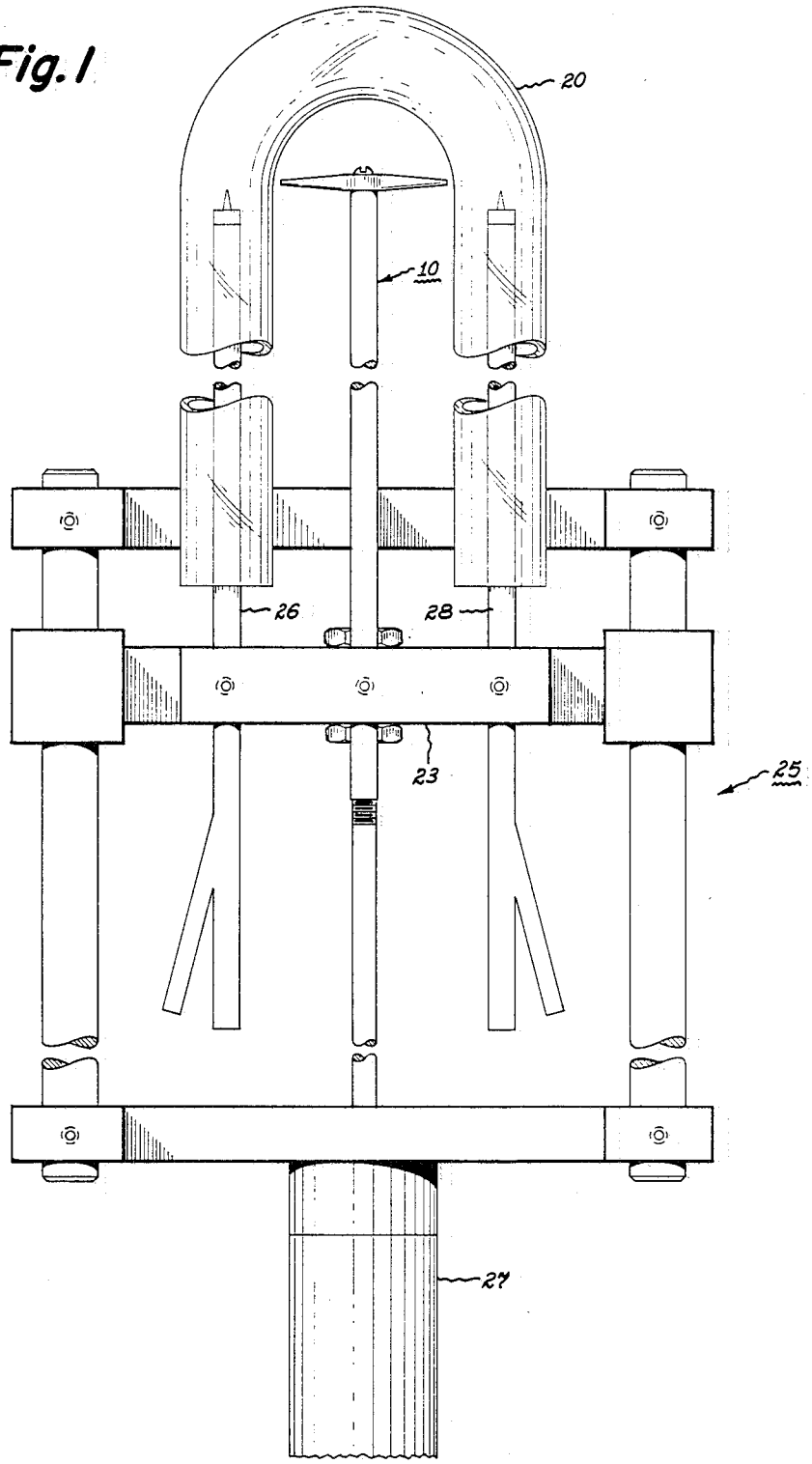
FIG. 1 is a schematic elevation view of a fluorescent lamp coating apparatus according to the present invention.
Figures 2, 3:
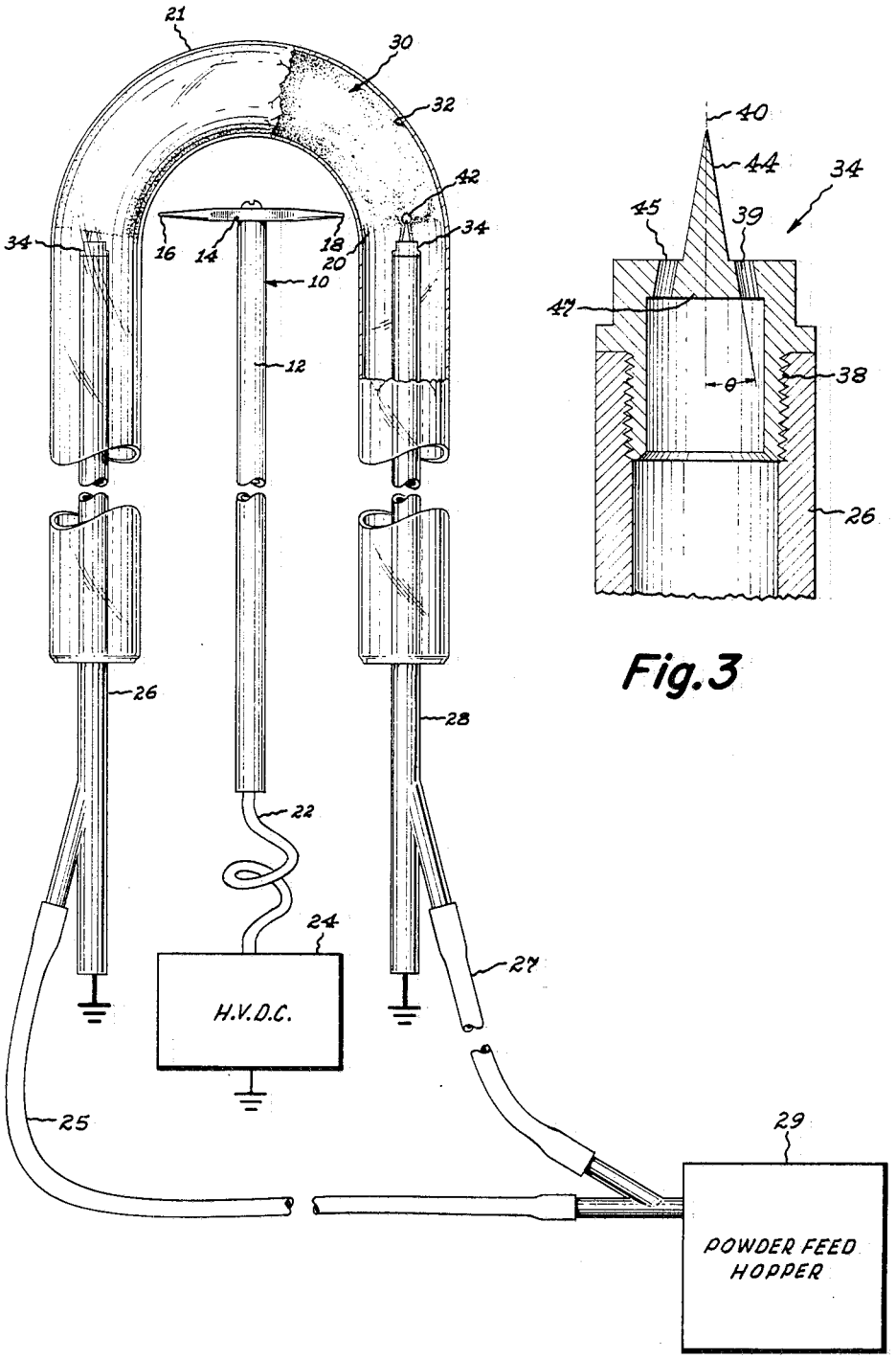
FIG. 2 is a schematic elevation view, partly in section, of an apparatus according to the present invention for applying coatings to the interior surface of fluorescent lamp tubes.
FIG. 3 is a schematic partial cross-sectional view of a nozzle for the coating apparatus of the present invention, enlarged to illustrate details thereof.

As shown schematically in FIG. 1, the apparatus of the present invention comprises equipment for coating the interior surface of a fluorescent lamp glass tube while the tube is suspended in a suitable holding device (not shown). The coating apparatus includes a high voltage electrode 10 and a pair of phosphor supply tubes 26, 28 secured to a movement mechanism 25 for moving the electrode 10 and supply tubes 26, 28 relative to the glass tube 20 at a controllable, constant rate. The movement mechanism may include hydraulic, compressed air or electric motor means 27 to provide the controlled movement. The electrode 10 and supply tubes 26, 28 are secured to suitable holders 23 for movement together during phosphor deposition. As shown in more detail in FIG. 2, a high voltage electrode 10 comprising conductive rod 12 and conductive tip member 14 is disposed so that the points 16, 18 at the respective ends of the conductive member 14 are in close proximity to the glass tube 20 but are not in contact therewith. The rod 12 is connected via a suitable conductor shown schematically as 22 to a high voltage d-c power supply 24. The present apparatus further includes supply tubes 26 and 28 for receiving via tubes 25, 27, respectively, a mixture of dry air and powder from a powder supply hopper 29 of conventional design, such as a fluidized bed, and conveying the mixture of dry air and powder to the interior 30 of the glass tube 20 for coating the interior surface 32 thereof. The nozzles 34 are both of a similar construction, one of which is shown enlarged in FIG. 3. The tube 26 is connected to a nozzle 34 for example by threads 38. The nozzle 34 includes a plurality of passages 39 cut through the closed end wall 47 at a predetermined angle with respect to the nozzle centerline 40 to concentrate the phosphor powder in the corona region 42 surrounding tip 44. The angle is determined experimentally to provide optimum powder flow from the nozzle past the tip 44 and through the corona region 42 into the interior of the glass tube for deposition upon the surface 32, shown in FIG. 2. The angle $\theta$ determines the distance of travel of the phosphor particles before deposition on the glass surface. The passages 39 are typically 50–100 mils in diameter, substantially larger than the particle size of the phosphor being deposited. The passages 39 may be cut with a slight spiral to cause the phosphor particles to swirl as they pass over the tip. The tube 26 may be a copper tube having a plastic coating to prevent erosion of the tubing by fluorescent phosphor particles supplied to the interior of the lamp, or alternatively the tube 26 may be a stainless steel tube requiring no inner lining. The tip 34 is preferably of stainless steel. The rod 12 and tip member 14 are preferably of copper or other suitable conductive material. Although the conductive member 14 is shown to be in the plane of the U-shaped glass tube 20, the rod 12 and tip member 14 may be offset, e.g., above the plane of the paper as shown in FIG. 2 but in a plane generally parallel to the plane including the respective centerlines 40 of the tips 44, so that it may be positioned nearer the top 21 of the bend in the glass tube 20. By using the offset position, the tip member 14 may be positioned to ensure deposition of phosphor powder over the entire surface of the curve in the lamp if required for particular phosphors.

An alternative embodiment is illustrated schematically in FIG. 4 for the application of phosphor coatings to a different type of U-shaped fluorescent lamp. The lamp tube 50 is a glass fluorescent tube used in twin-tube lamps of the type sold by the General Electric Company under the trademark MOD-U-LINE® having a sharp U-bend and smaller diameter, typically T-5 approximately $\frac{5}{8}$ inch diameter, than the lamp shown in FIG. 2. For coating a lamp of this configuration the central rod 52 has a tip 54 attached thereto generally aligned with the axis 56 of the rod 52. The pair of supply tubes 58 and 60 are configured to have bends 62, 64 and 66, 68, respectively, to position the supply tubes properly for insertion into the legs 74, 76 of the U-shaped lamp tube 50. The supply tubes have nozzles 70, 72 of a construction similar to nozzle 34, described above, but of smaller diameter connected respectively thereto. The materials of the rod 52 and the supply tubes 58 and 60 and the nozzle 70 and 72 are as described above with respect to the embodiment of FIG. 2. The rod 52 and tip 54 could be offset from the plane of the glass tube 50, rather than being in the plane of the tube 50, so that the tip 54 could be positioned adjacent the U-shaped bend rather than within the U-shaped bend. The tip 54 could be provided by turning the tip member 14 perpendicular to the plane of the glass tube and positioning one of the tips 16 or 18 in close proximity to the bend of the tube 50 of FIG. 2.

Figure 7:
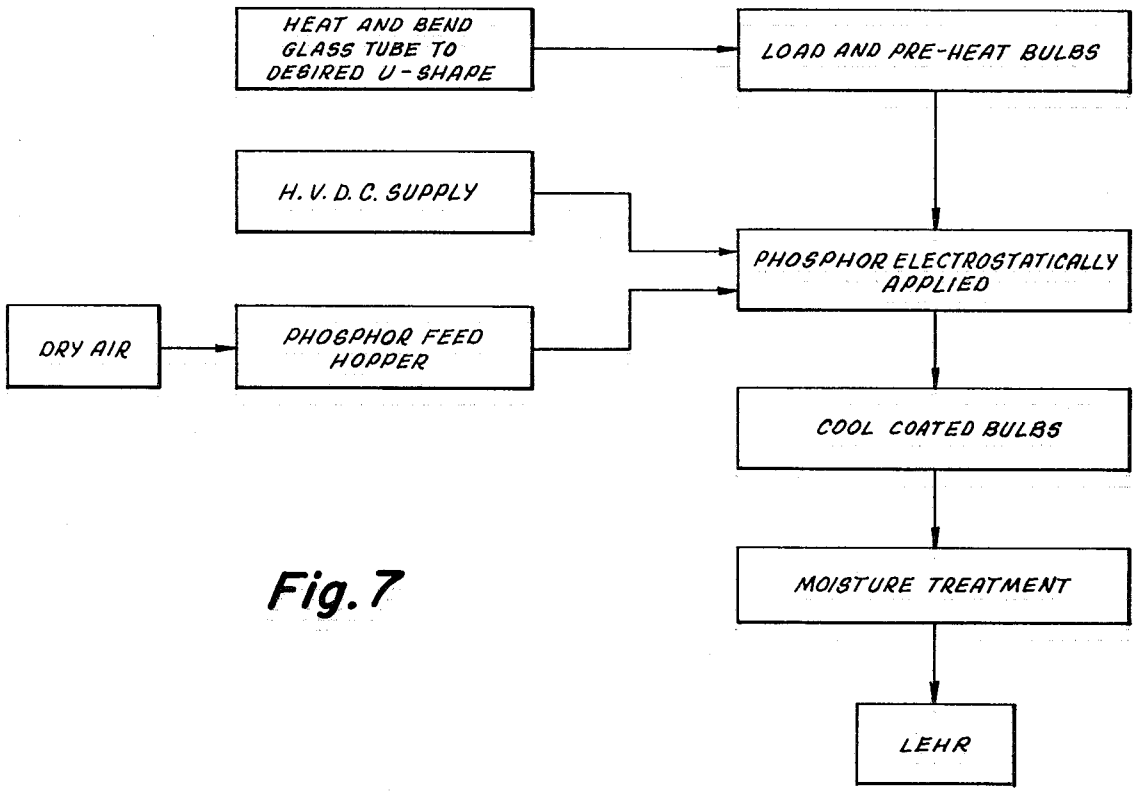
FIG. 7 is a block diagram illustrating the phosphor deposition method of the present invention.

The present invention provides a method of phosphor deposition as shown in the block diagram of FIG. 7, as follows: the glass fluorescent tube is bent into the U-shaped configuration while heated. While the glass tube is still hot, it is loaded into a suitable lamp holding mechanism for deposition of the phosphor coatings. Alternatively, the bulbs may be allowed to cool and then be reheated. The heating removes moisture from the surface of the glass tubes and thereby reduces surface conductivity, which would interfere with the application of charge to the glass surface. The supply tubes 26 and 28 are inserted into the legs of the U-shaped lamp, and the electrode tips 16 and 18 are positioned adjacent the glass tube wall and slightly above and generally adjacent the position of the tips of the nozzles. The supply tubes 26 and 28 are connected to electrical ground. The power supply 24 connected to the rod 12 supplies a D.C. voltage in the range of 20 to 50 kv. The exact setting for a particular deposition is established by raising the voltage to a level at which breakdown occurs in air and then reducing the voltage level slightly to avoid arcing. This spacing is typically in the range of about 0.50 inch to about 2.00 inches. A supply of dry air or other suitable gas is provided to the phosphor feed hopper to entrain particulate matter in a stream flowing vertically upward through the tubes 26, 28 into the bight of the glass tube. The phosphor particles are charged as they pass through the corona region 42. The phosphor particle size is typically 3.0 to 15.0 microns plus or minus 15 percent at the particle's maximum dimension, which is standard for fluorescent phosphor particle size. The passages 39 are thus much larger in diameter than the particles and do not significantly affect particle velocity through the nozzles. Typically the phosphor particles travel about four to six inches beyond the openings 45 before contacting the glass tube wall. The powder supply nozzles and the electrode member 14 are moved vertically downward at a rate determined by the desired thickness of deposition upon the interior surface of the glass wall, e.g., at about 5 inches per second for coating the T-12 or approximately 1.5 inch diameter tube shown in the FIG. 2 embodiment. Alternatively, the glass tube could be moved while the powder supply tubes and the electrode are kept fixed. If it is desired to deposit a second layer of phosphor coating onto the interior surface of the lamp glass, a second step of electrostatic deposition may be employed by moving the nozzels and electrode 10 back to their beginning positions and repeating the procedure described above. If a different phosphor is to be used for the second deposition, the appropriate supply hopper would be connected to tubes 25, 27 prior to the beginning of the second deposition step. Following electrostatic deposition of phosphors the coated bulb is cooled in air. Whether one layer or two or more layers have been deposited, the phosphor coating is humidified by blowing saturated air into the interior of the tube so that moisture is picked up on the surfaces of the particulate phosphor material. Following humidification the lamp is lehred to remove the water introduced into the lamp by humidification and to bond the phosphor particles to the glass surface and to other particles in the phosphor coatings, so that the phosphor layers will be securely bonded to the lamp interior surface after manufacture. Then a fluorescent lamp stem, including an electrode and supporting leads sealed in the glass stem is attached to each respective end of the U-shaped lamp tube. A suitable quantity of mercury is disposed in the lamp to provide a mercury vapor discharge path in the lamp, and a gas fill, such as argon or a mixture of krypton and argon, is added. The lamp is then sealed and end caps having suitable contact pins connected to the respective electrode leads are attached to finish the lamp.

During phosphor deposition the glass tube is maintained at a temperature range from about 150° C. to about 500° C. at which it is electrically conductive, so that a current flow of approximately 2.5 milliamperes flows through the rod 12 and from the tips 16 and 18 through the glass of the lamp tube and the phosphor particles in the interior of the glass to the respective tips 44 of the nozzles 34. The powder being blown through the respective supply tubes into the glass bulb picks up a negative charge as it passes the corona point. The current flowing through the glass wall causes the glass to accumulate a positive charge. As shown greatly enlarged in FIG. 5, the glass wall 20 accumulates a positive charge, shown at 80, and the phosphor particles 82 exhibit a negative charge. Because the glass tube is isolated from the electrical system and from electrical ground, the positive charge is retained, and therefore the particulate phosphor is caused to adhere to the glass surface. This retained charge will dissipate over time, but if properly isolated will retain adequate charge for a period of approximately 12 hours, so that the particulate phosphor can be bonded to the glass surface while it is still being held in place by the electrical attraction. The charge on the powder in the coating is retained because of the low conductivity of the powder. This allows sufficient time for the humidification and lehring of the coated lamp. As shown greatly enlarged in FIG. 6, a second layer 83 of phosphor particles 84 of substantially different size than the particles 82 is deposited over the first layer 81. Humidification causes the layers 81, 83 of phosphor particles to be densified due to the fact that moisture on the surfaces of the individual particles causes the phosphor particles to shift slightly relative to each other to reduce spaces between particles and become more closely packed to the surface of the glass by the mutual attraction of the electrostatic charge. This improves the uniformity of the phosphor coatings on the lamp glass. The particulate layers will be maintained generally separate along a line shown at 86 at a position generally corresponding to the thickness of the first particulate layer 81 from the surface of the glass wall. Upon lehring the particles of phosphor are bound together to the glass surface to form uniform, bonded layers as shown in FIG. 6.

A lower lehring temperature may be employed following the electrostatic deposition according to the present invention than is employed in prior art slurry deposition, because no organic binder containing carbon materials is used to initially bond the phosphor coatings to the glass. The lower lehring temperature, 475° C. to 600° C., which would be inadequate to burn out organic binder materials, is adequate to cause phosphor bonding and removal of water but is not high enough to cause softening of the glass. Therefore, the sag which is experienced at high temperature lehring is avoided for U-shaped lamps made according to the present invention, so that no distortion of lamp shape is caused by the lehring step. An additional advantage of the present invention is that only a limited amount of moisture is used in the humidifying of the lamps, thereby reducing the quantity of water which must be removed by lehring, so that the time required for lehring is less than that required by prior art techniques even though the lehring temperature is lower.

The electrostatic deposition process of the present invention is not adversely affected by the presence of a starting strip on the interior surface of the glass tube. For example, on lamps with the tin oxide starting stripe described above deposited on the interior of the U-shaped glass tube, the present invention performs phosphor deposition with no reduction of adherence of the phosphor to the starting stripe or insulating barrier layer. Further, the present invention facilitates deposition of phosphor mixtures which may include several particle sizes, because no gravitational separation would occur and the electrostatic bonding of phosphor particles to the glass surface would not be affected by particle size. Phosphors which are difficult to keep in suspension or are incompatible with an organic binder are readily applied by the electrostatic deposition process of the present invention because of the elimination of the binder.

The lamps of the present invention include both types of U-shaped fluorescent lamps shown in FIG. 2 and FIG. 4 having one or more layers of phosphor particles as shown in FIGS. 5 and 6 bonded thereto and completely devoid of any residue of organic binder. Each phosphor layer may include a mixture of more than one particle size or may be a single particle size. Further the lamps may include an internal starting strip with insulating barrier or may have no internal starting aid.

It will be appreciated by those skilled in the art that the present system of electrostatic deposition of phosphors for fluorescent lamps eliminates the need for organic binders in phosphor deposition with the resultant savings of material and energy consumption while fluorescent lamp production can be completed in less time.

What I claim as new and desire to secure by Letters Patent of the United States is:

1. An apparatus for applying phosphor coatings to U-shaped fluorescent lamp tubes while said lamp tubes are disposed in suitable holding means comprising:

power supply means for supplying a high voltage d-c potential;

electrode means connected to said power supply means for applying a high voltage d-c potential in close proximity to a U-shaped fluorescent lamp tube;

particulate material supply means for supplying a continuous flow of particulate material;

particulate material deposition means connected to said particulate material supply means for providing said particulate material into the interior of said lamp tube and for applying an electrical charge to said particulate material and dispersing said particulate material into said interior of said lamp tube; and means for moving said electrode means and said particulate material deposition means relative to said lamp tube.

2. The invention of claim 1 wherein said particulate material deposition means comprises:

first and second hollow, conductive feed tube means disposed generally parallel to each other for receiving said continuous flow of said particulate material and supplying, respectively, first and second continuous streams of said particulate material to the interior of the respective legs of said lamp tube; and first and second nozzle means connected, respectively, to said first and second feed tube means for passing said first and second continuous streams, respectively, through respective first and second corona regions as said particles pass out of said respective nozzle means to cause the particles of said first and second continuous streams to become electrically charged with a first polarity.

3. The invention of claim 2 wherein:

each of said feed tube means comprises a hollow, electrically conductive tube means connected to electrical ground.

4. The invention of claim 3 wherein each of said first and second nozzle means comprises:

a hollow generally circular cylindrical body open at one end thereof and having at the opposite and thereof an end wall having a conductive tip projecting therefrom and a plurality of passages therethrough for directing the flow of particulate material over said conductive tip.

5. The invention of claim 4 wherein said electrode means comprises:

a conductive rod disposed generally between and parallel to said first and second feed tube means; and a conductive tip member attached to said conductive rod and disposed generally between said first and second feed tube means.

6. The invention of claim 5 wherein said conductive tip member comprises:

a elongated conductive member being tapered to a point at each respective end thereof attached to said conductive rod and disposed perpendicular thereto and extending generally parallel to a plane including the centerlines of both of said first and second nozzle means.

7. The invention of claim 6 wherein:

said passages pass through said end wall at a predetermined angle relative to the center line of said body such that particles of said stream of particulate material are directed toward a corona point upon emerging from said passages; and said conductive tip comprises a conical projection from said end wall having an angle of taper approximately equal to said predetermined angle.

8. The invention of claim 7 wherein:

said nozzle means and said feed tube means are constructed of stainless steel.

9. The invention of claim 7 wherein said power supply means comprises:

a controllable d-c power supply means for providing a d-c output in the range of 20,000 to 50,000 volts.

10. The invention of claim 5 wherein said conductive tip member comprises:

a straight conductive member attached to said conductive rod and disposed generally in axial alignment therewith so that the tip thereof is disposed between the tips of said nozzle means.

11. The invention of claim 5 Wherein said conductive tip member comprises:

a straight conductive member attached to said conductive rod and disposed generally perpendicular thereto and generally perpendicular to a plane which includes the centerlines of both of said nozzles means.

12. A method of depositing a phosphor coating on the interior surface of U-shaped fluorescent lamp tubes comprising the steps of:

supplying particulate phosphor material to the interior of a fluorescent lamp tube via a pair of phosphor supply tubes disposed inside a U-shaped glass lamp tube;

applying an electrical charge of a first predetermined polarity to particles of said particulate phosphor material as said particles exit each respective one of said phosphor supply tubes;

applying an electrical charge of a second predetermined polarity opposite said first polarity to said lamp tube; and moving said phosphor supply tubes relative to said lamp tube so that a generally uniform coating of said particulate phosphor material is deposited over the inner surface of said fluorescent lamp tube.

13. The invention of claim 12 wherein said steps of applying electrical charges to said particles and lamp tube comprise:

applying a high voltage d-c electrical potential to an electrode member disposed in close proximity to the exterior surface of said fluorescent lamp tube;

connecting each of said phosphor supply tubes to electrical ground; and moving said electrode member relative to said lamp tube simultaneously with moving said phosphor supply tubes.

14. The invention of claim 13 further comprising:
humidifying the interior of said fluorescent lamp tube; and
lehring said fluorescent lamp at a predetermined temperature for a predetermined time to remove moisture from the interior of said fluorescent lamp tube and to bond said particulate phosphor material to said fluorescent lamp tube.

15. The invention of claim 14 wherein said step of applying a high voltage d-c potential comprises:
supplying a d-c voltage in the range of 20,000 to 50,000 volts to said electrode member.

16. The invention of claim 15 wherein:
said step of applying an electrical charge to said particles comprises applying a negative charge to said particles; and
said step of applying an electrical charge to said lamp tube comprises applying a positive charge to said lamp tube.

17. The invention of claim 16 wherein said step of moving said phosphor supply tubes relative to said lamp tube comprises:
moving said phosphor supply tubes at a predetermined rate.

18. The invention of claim 17 wherein said predetermined rate comprises:
a rate of about 5.0 inches per second.

19. The invention of claim 13 further comprising:
prior to said step of supplying particulate phosphor material; positioning first and second nozzle tips attached to respective ones of said phosphor supply tubes at a predetermined position within the parallel legs of said lamp tube relative to the bight of said U-shaped glass lamp tube; and
positioning said electrode member at a position between the edge of said bight of said glass lamp tube and a plane through the ends of said nozzle tips.

20. The invention of claim 19 wherein:
said step of applying said high voltage d-c electrical potential comprises producing a corona surrounding each of said respective nozzle tips during said step of moving said electrode member and said phosphor supply tubes.

21. The invention of claim 20 wherein:
said steps of moving said electrode member and said phosphor supply tubes comprises moving said electrode member and said phosphor supply tubes the entire length of the legs of said U-shaped glass lamp tube.

22. A method of depositing phosphor materials on the interior surface of U-shaped fluorescent lamp tubes comprising the steps of:
supplying a first particulate phosphor material to the interior of said fluorescent lamp tube via a pair of electrically grounded phosphor supply tubes;
applying a high voltage d-c electrical potential to an electrode member disposed in close proximity to the exterior surface of said fluorescent lamp tube;
moving said electrode member and said phosphor supply tubes relative to said fluorescent lamp tube so that a first generally uniform coating of said first particulate phosphor material is deposited over the inner surface of said fluorescent lamp tube;
supplying a second particulate phosphor material to the interior of said fluorescent lamp tube via said pair of phosphor supply tubes;
applying a second time a high voltage d-c electrical potential to said electrode member disposed in close proximity to the exterior surface of said fluorescent lamp tube; and
moving said electrode and said phosphor supply tubes relative to said fluorescent lamp tube so that a second generally uniform coating of said second particulate phosphor material is deposited over said first coating of said first particulate phosphor material.

23. The method of claim 22 further comprising:
after said first and second coatings are deposited humidifying the interior of said fluorescent lamp tube; and
lehring said fluorescent lamp tube at a predetermined lehring temperature for a predetermined time to remove moisture from the interior of said fluorescent lamp tube and to bond said particulate phosphor materials to said fluorescent lamp tube.

24. The invention of claim 23 wherein:
said predetermined lehring temperature is in the range of 475 degrees centigrade to 600 degrees centigrade.

25. The invention of claim 23 wherein said step of humidifying comprises:
supplying saturated air to the interior of said fluorescent lamp tube.

26. The invention of claim 22 wherein each step of applying a high voltage d-c potential comprises:
supplying a d-c voltage in the range of 20,000 to 50,000 volts to said electrode member.

27. The invention of claim 22 further comprising:
prior to said step of supplying said first particulate phosphor material; heating said fluorescent lamp glass tube to a predetermined temperature sufficient to cause the glass tube to beecome conductive.

28. The invention of claim 27 wherein said predetermined temperature is in the range of 150 degrees centigrade to 500 degrees centigrade.

* * * * *